US005556104A

United States Patent [19]

Guillen, Jr.

[11] Patent Number: 5,556,104

[45] Date of Patent: Sep. 17, 1996

[54] SOCCER PRACTICE DEVICE

[76] Inventor: Jose E. Guillen, Jr., 8211 Holiday, Houston, Tex. 77075

[21] Appl. No.: 421,372

[22] Filed: Apr. 12, 1995

[51] Int. Cl.[6] ..... A63B 63/00

[52] U.S. Cl. ..... 273/396; 273/400; 273/411

[58] Field of Search ..... 273/394, 395, 273/396, 397, 398, 400, 402, 411, 413, 414, 26 A

[56] References Cited

U.S. PATENT DOCUMENTS

| | | | |
|---|---|---|---|
| 2,873,969 | 2/1959 | Ziel | 273/26 A |
| 2,944,816 | 7/1960 | Dixon | 273/26 |
| 3,013,801 | 12/1961 | Kirkconnell, Jr. | 273/26 A X |
| 4,258,924 | 3/1981 | Ketchum | 273/411 |
| 4,516,769 | 5/1985 | Kopp | 273/411 X |
| 4,616,834 | 10/1986 | Davis | 273/411 |
| 4,650,189 | 3/1987 | Rajachich | 273/264 |
| 4,842,284 | 6/1989 | Rushing et al. | 273/395 |
| 4,865,330 | 9/1989 | D'Amico | 273/411 |
| 5,083,797 | 1/1992 | Vartwa et al. | 273/414 |
| 5,280,922 | 1/1994 | Jones | 273/411 |
| 5,346,228 | 9/1994 | Offutt | 273/402 |

*Primary Examiner*—William H. Grieb
*Attorney, Agent, or Firm*—John Moetteli

[57] ABSTRACT

A practice device is provided for practicing soccer ball kicking and passing techniques comprising essentially a frame and a rebound surface and optional netting. When the practice device is positioned at a certain distance from the practicing student and the soccer ball is kicked or passed to the practice device, the soccer ball impacts the solid upright portion of the device and then rebounds back to the soccer student thereby challenging his kicking accuracy and response reflex while minimizing his efforts to retrieve the soccer ball. The device is particularly suitable for the training of younger students to improve their soccer skills and technical abilities.

8 Claims, 5 Drawing Sheets

SOCCER PRACTICE DEVICE

TECHNICAL FIELD

The present invention relates to training devices for practicing soccer skills. More specifically, the present invention relates to a training device used in teaching and practicing kicking and passing techniques when a soccer ball is passed to the student in such a manner as to require an immediate response.

BACKGROUND

Kicking a soccer ball improperly is common among inexperienced or young soccer students. Early in the development of the sport, kicking and passing techniques were taught almost exclusively by explanation and demonstration in which the teacher or the coach kicks or throws a ball at a practicing student who then attempts to kick or throw the ball back to the coach. This method tends to be intimidating (perhaps because of the instinctive defense reaction that is triggered when a person, such as the coach, intentionally and suddenly throws a ball at the student) and can reinforce improper techniques such as kicking the ball incorrectly (i.e. with wrong portion of the foot). This method further necessitates at least two persons, and a large area in which to train, but without doubt it provides the most realistic and skill-oriented training to the student. However, because two persons and sufficient training space are not always available, various training devices have been developed to enable self-training in smaller training areas.

Such devices are designed with the goals of (1) assisting in the development of effective techniques, (2) minimizing unproductive time, (3) maximizing the number of students which may practice in a given playing or practice field, and/or (4) improving ease of transport, setup, use and disassembly of such devices. The training devices most relevant to the present invention comprise portable rebounding nets which prevent the user from having to chase and retrieve the ball every time he or she kicks it. These devices focus on addressing the second and third design goals listed above. An example of such a device which is used by pitchers in training for baseball is the "CANVAS CATCHER" (™). This invention is described in U.S. Pat. No. 2,944,816 (the '816 patent) to Dixon. The '816 patent describes a device having a substantially vertical frame to which netting is attached and a buttress-like support fixable to the ground. In training for soccer, football, baseball, and basketball, the "PRACTICE PARTNER" (™), described in U.S. Pat. No. 4,650,189 (the '189 patent) to Rajachich, may be used. The '189 patent describes an apparatus constructed of three net planes arranged in an inverted Y (or lambda) configuration such that two students may simultaneously use the apparatus by playing on opposite sides thereof. However, none of the rebound devices described above deal effectively with design goal one above, a significant consideration of which is to provide a means for the student to practice his quick return response thus helping sharpen the student's reflex or reaction time to a ball approaching him within a very short time interval from his last kick and at relatively high speed.

Another species of kick training device are those which provide some sort of attachment to the ball such that the ball may not leave the immediate vicinity of the student after it has been kicked. This sort of training device is described in U.S. Pat. Nos. 5,280,922 to Jones, 4,616,834 to Davis, 5,083,797 to Vartija et al and 4,516,769 to Kopp. The most significant disadvantage to this species of training device is the interference which the attachment means has on the reaction of the ball to the student's kick. This interference causes the balls reaction to be unnatural and often unpredictable. Because, generally speaking, training devices are judged on their ability to simulate actual play, such devices which attach to the ball are not preferred and do not effectively address design goal one listed above. However, to their credit, these inventions do address design goals two through four effectively.

A need therefore exists for an improved training device which provides a means for a student to practice his quick return response thus helping the student sharpen his reflex or reaction time to a ball approaching suddenly and at relatively high speed, while at the same time eliminating attachments which interfere with the reaction of the ball to the student's kick, thus meeting the remaining design goals listed above.

SUMMARY

The present invention is directed to an improved soccer training device that satisfies the needs identified above. The present invention comprises a tubular frame structure which attaches to the ground along one end and provides support for a rigid substantially vertical rebound surface on the other. Netting may be hung on the frame such that repositioning of the device (reorienting the device between 90 and 150 degrees with respect a horizontal axis perpendicular to the student's line of sight to the device, and then rotating the device 180 degrees with respect to the vertical axis) provides a small target goal into which a soccer ball may be kicked. Further, the rebound surface may be reoriented such that a rebounding ball returns on an upward trajectory—this is accomplished simply by turning the invention over and fastening it to the ground in this new orientation. In either orientation, the rebound surface acts to rebound the soccer ball upon impact, thereby providing a means to practice the quick return response of a soccer student to the ball in order to help sharpen the student's reflex or shorten reaction time to the ball which may be approaching him at relatively high speed. At the same time, the invention eliminates attachments to the soccer ball which interfere with the reaction of the ball to the student's kick.

The principal objective of the present invention is to provide a device for use in training soccer students in effective and safe kicking techniques.

In line with this objective, the present invention provides a means to increase students' confidence levels and potential for advanced skill development by providing three distinct practice modes in a single invention. These practice modes are attainable by simple reorientation or outfitting of the invention in any of three setups.

When oriented in a first and second mode, the student is able to determine the type of kick that he or she must respond to—whether the ball returns along the ground or returns on a parabolic trajectory (respectively). When oriented in the second position (the device turned upside down), the student can learn how to trap a soccer ball when it is kicked to him. Learning the fundamentals of trapping a soccer ball is basic to successful team play. For example, a child using the device learns to prepare himself almost instantly so that he can control the ball quickly and with confidence, trapping the soccer ball with the foot, thigh, chest and head. When reoriented in a third position, this soccer practice device can be used as a miniature soccer goal with a net attached to its frame. Because of this feature, a soccer student may kick the soccer ball into the goal and net without the frustration of having to chase and retrieve the soccer ball.

A second objective of the present invention is to provide a device which minimizes unproductive time, such as that normally expended in chasing down and retrieving a soccer ball after a practice kick.

A third objective of the present invention is to maximize the number of students which may practice in a given playing or practice field or conversely, minimize the space required for effective practice for a single student.

A fourth objective of the present invention is to improve ease of transport, setup, use and disassembly of such devices. Therefore, a device of lightweight, portable form is provided. It can be carried easily to a training site or placed in the trunk of a car for transportation to another location.

BRIEF DESCRIPTION OF THE DRAWINGS

Other objects and advantages of this invention will become readily apparent as the same is better understood by reference to the following detailed description when considered in connection with the accompanying drawings wherein.

DETAILED DESCRIPTION

Figure 1:
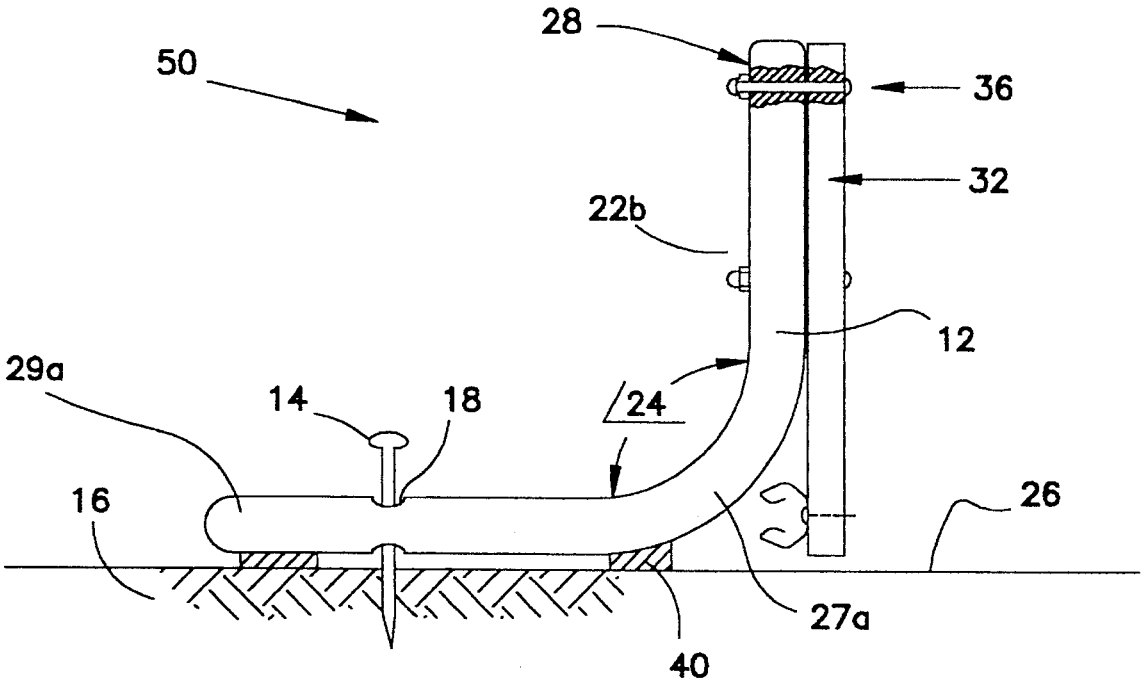
FIG. 1 is a left-side elevation view of a soccer practice device in accordance with the present invention.
Figure 5:
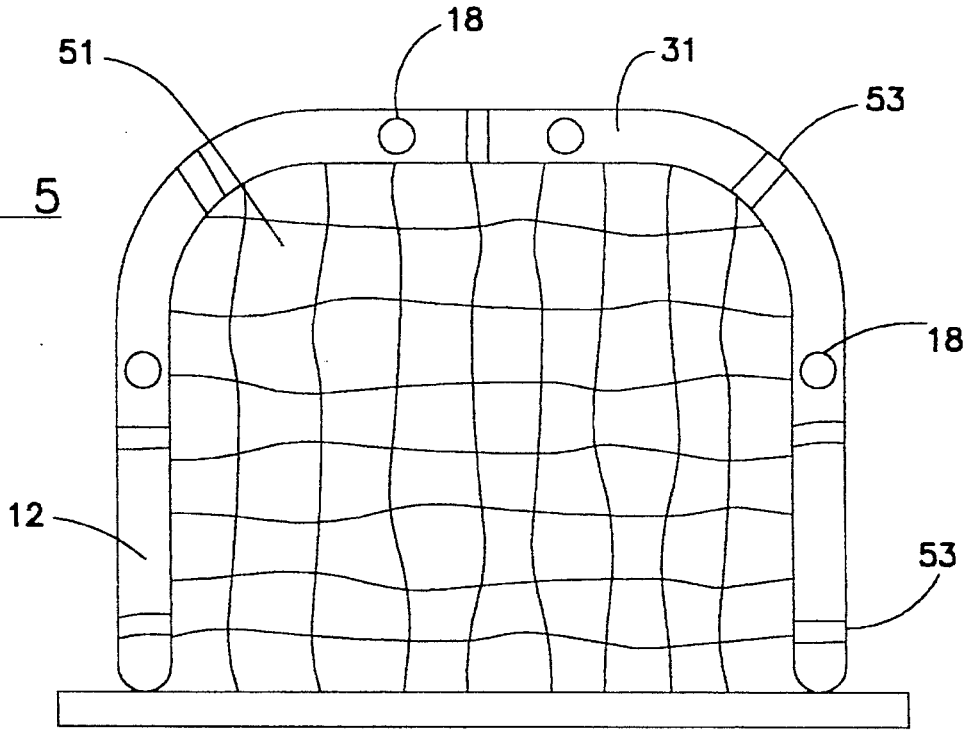
FIG. 5 and FIG. 6 are the front and right-side elevation views of the soccer practice device when reoriented as compared to FIGS. 1 through 4 and incorporating a soccer net in accordance with one embodiment of the present invention.
Figure 6:
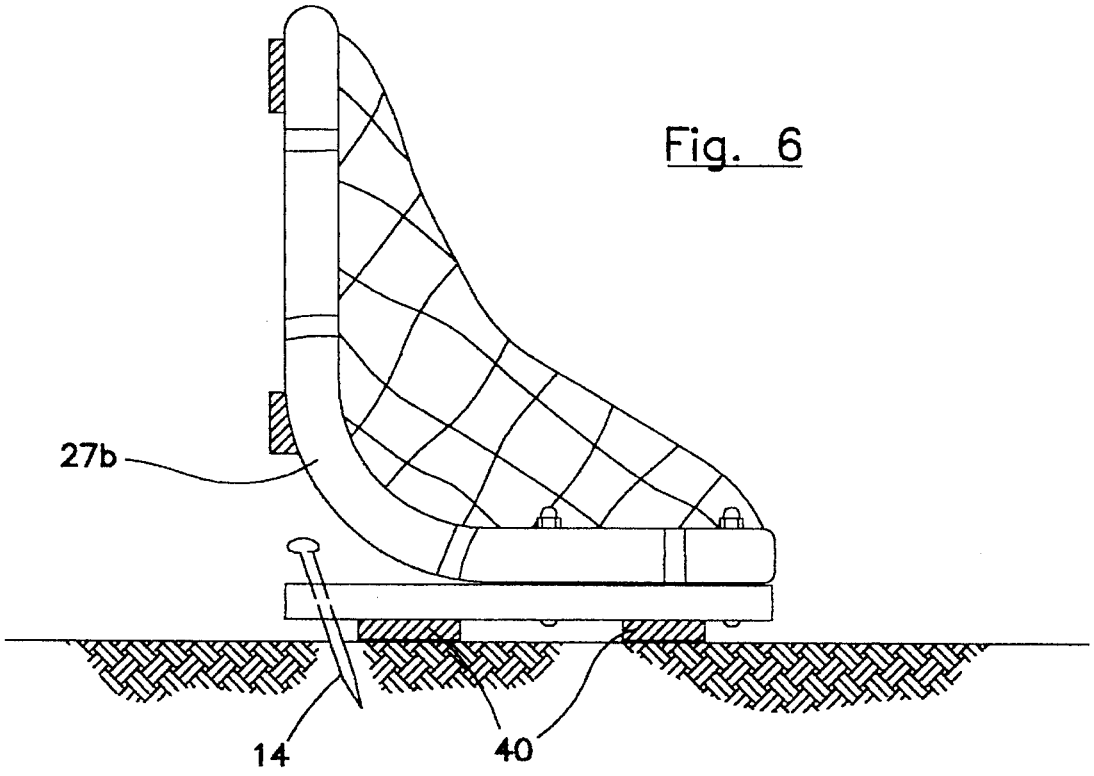

Referring now to FIGS. 1 through 4 wherein is shown a preferred embodiment and wherein like reference numerals designate like elements throughout the several views, there is shown in FIG. 1 a frame 12 constructed of preferably strong lightweight tubular material and a rigid structure 32 attached thereto. In the most preferred embodiment, the frame 12 is generally comprised of opposite portions 22*a* and 22*b* and 29*a* and 29*b*, two intermediate portions 27*a* and 27*b* and at least one crossmember 31 which spans the distance between portions 29*a* and 29*b* (shown most clearly in FIGS. 3, 4 and 5), such portions together forming a single unitary frame structure of lightweight tubular material (any of a variety of crosssections would function adequately, whether square, oval, round, or dog-bone shaped).

Figure 10:
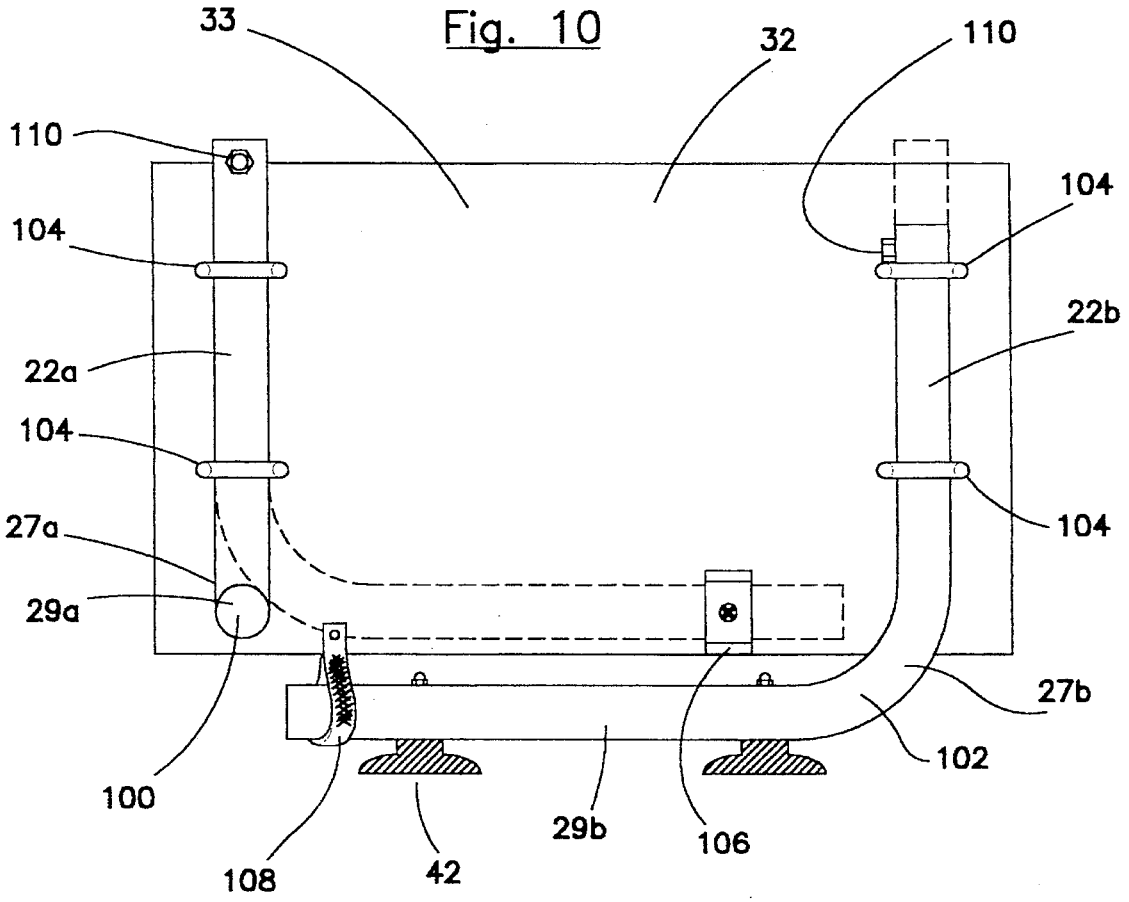
FIG. 10 is the back elevation view of a soccer practice device in accordance with the present invention wherein a collapsable frame is shown.

In an alternate embodiment to a single unitary frame structure as shown in FIG. 10, the frame is comprised of first and second supports 100 and 102, each comprised respectively of first opposite portions 22*a*, 29*a* and first intermediate portion 27*a*, and of second opposite portions 22*b*, 29*b* and second intermediate portion 27*b*. Each support 100 and 102 is fastened to the rigid structure 32 along the length of upper portions 22*a* and 22*b*. In this alternate embodiment, the cross member 31 is either eliminated or separately attachable. U-bolts or pipe-hanging straps 104 (which wrap around the circumference of the two supports 100 and 102 in the area of portions 22*a* and 22*b*) are advantageously used to fasten each of the first and second supports 100 and 102 to the rigid structure 32 yet permit each support 100 and 102 to fold back against the rear surface 33 of the rigid structure 31 for compact storage or carrying. Optionally, a resilient clip 106 as typically used in the art to removeably fasten tubular material to a surface may be utilized to hold the first and second supports 100 and 102 to the rigid structure 31 against rear surface 33 during storage and transportation. A strap 108 having VELCRO or clasp-type snaps is shown which may optionally be used to restrain the ends 29*a* or 29*b* after folding toward the surface 33. Protrusions 110 such as screw heads are provided at the ends of portions 22*a* and 22*b* in order to restrict axial movement of first and second supports 100 and 102 beyond the amount necessary to allow either support 100 or 102 to extend beyond the other support to permit either portion 29*a* or 29*b* to lay flat with respect to the plane of surface 33.

In either the preferred or alternate embodiment, a spike or anchor 14 may be forced into the ground 16 through holes 18 in frame 12 to secure the device against movement when impacted by a soccer ball 20. The frame 12 is bent in the region of the intermediate portions 27*a* and 27*b* at an angle 24, measured between portions 22*a* and 22*b* and opposite portions 29*a* and 29*b*, most clearly shown in FIG. 1. This angle 24 is preferably chosen to fall within a range between 40 and 80 degrees so that when the device is reoriented with respect to the surface 26, it may be positioned at approximately 90 degrees or alternatively 120 degrees with respect to the surface 26 on which the device is used (in this case, the ground 16 and considering opposite portions 22*a* and 22*b* and 29*a* and 29*b* of approximately 18 inches in length).

In the preferred embodiment as depicted in the drawings, the upper portion 28 of arms 22*a* and 22*b* of the frame 12 are fastened to the board or rigid planar structure 32 by means of a fastener such as a bolt or screw 36 which passes through the frame 12 and into the rigid planar structure 32 as most clearly shown in FIG. 1. The rigid planar structure 32 of the practice device is comprised of a solid piece of preferably wood, metal, plastic or fiberglass material about 1.5 inch thick, 11.5 inches wide, and 24 inches long. Its size of course may increase or decrease without departing from the spirit of the invention. In addition, a decal or graphic of a target 54, or company or team logo may be affixed to the exposed surfaces of this rigid planar structure 32.

The tubular construction of the soccer practice device allows it to be lightweight and easily carried by a young soccer student 52. It can also be built of a size and shape which can be easily placed into the trunk of an automobile for transportation, or used indoors at a home or gymnasium. Such is a significant intent of the preferred embodiment described above. When used in a gymnasium it is necessary to protect the wooden floor 38 from damage by the frame 12. In addition, because it is undesirable to attempt to hammer spikes or stakes 14 into the polished wooden floor 38 of the gymnasium, the spikes, stakes or anchors 14 described in the preferred embodiment above cannot be used. Alternatively, resistance to displacement upon the impact of a moving soccer ball 20 can be accomplished by attaching frictional padding 40 to the portion of the frame 12 which would otherwise contact the floor 38. Such pads are shown in FIGS.

1 and 2. Suction cups 42 (shown in FIG. 4) or alternative fastening or stabilizing means can be used to further enhance the invention's resistance to displacement upon the impact of a soccer ball 20. For example, additional weight may be placed on the frame structure itself or the frame may be wedged underneath any suitable fixed structure (e.g. bleachers) in the gymnasium.

Operation—Method of Use

Figure 7:
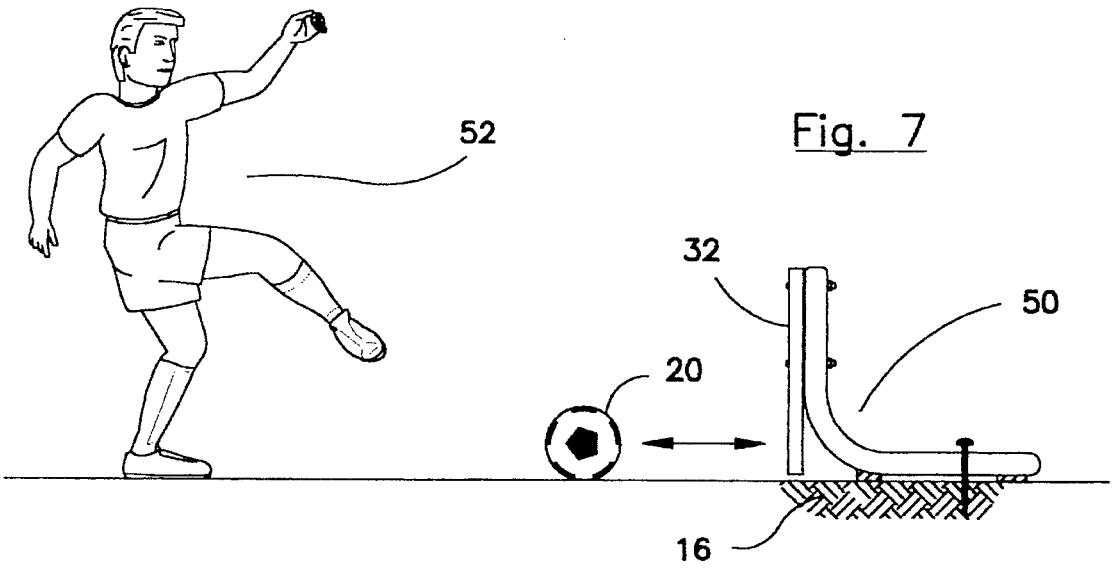
FIGS. 7, 8 and 9 are side views showing the invention in use in three different setups.
Figure 8:
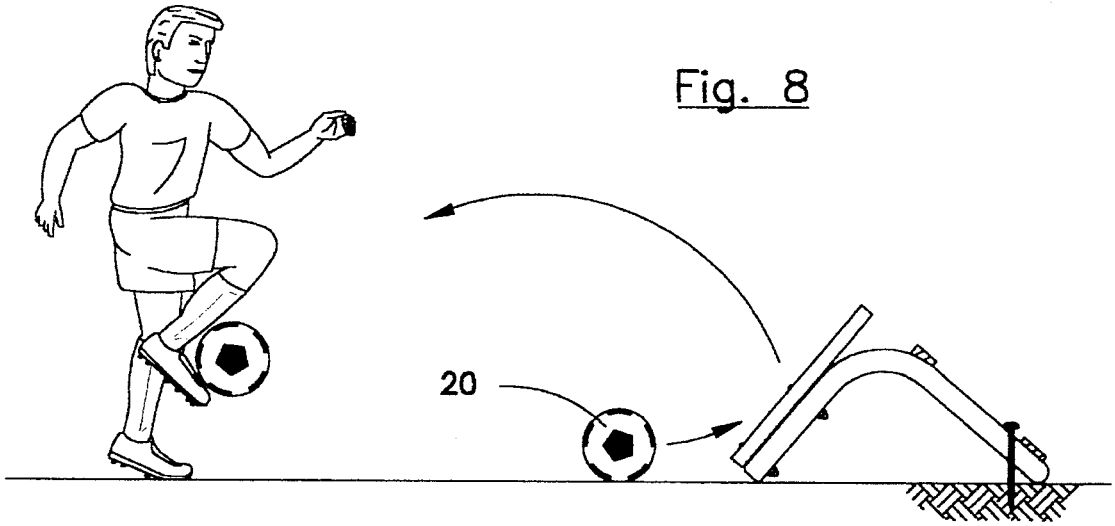
Figure 9:
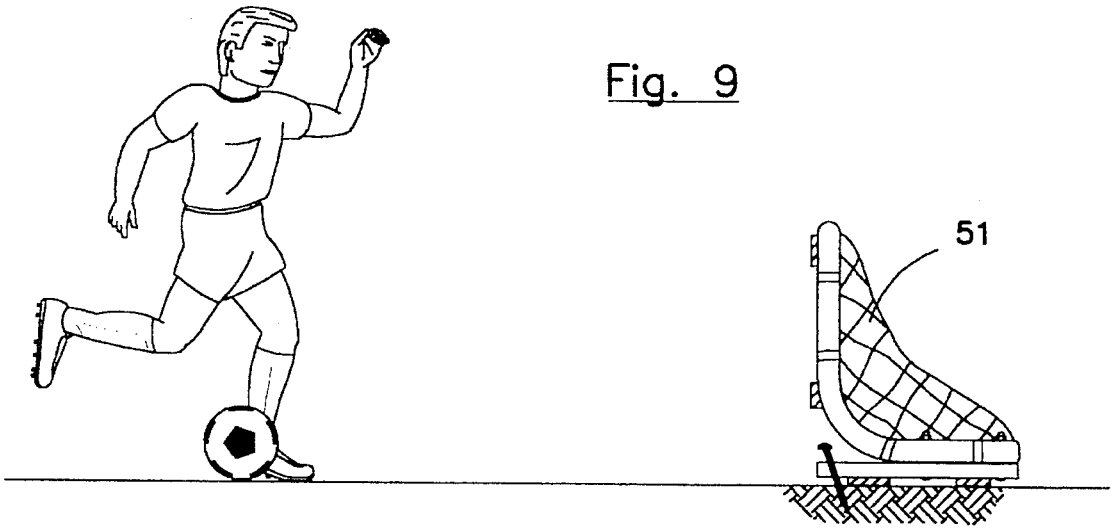

The following description is best understood in reference to FIGS. 7, 8 and 9.

For an inexperienced student, the soccer ball 20 may be positioned at about 2 to 3 feet from the soccer practice device 50. More experienced students can play the ball 20 against the board 32 from a greater distance. Because the device 50 is stationary and the board 32 rigid, the resilient ball 20 readily deflects off the board 32 and returns to the student 52. Thus, the student 52 can be instructed in proper kicking techniques and then can practice such techniques without chasing a soccer ball 20 every time it has been kicked. As the student 52 gains more confidence, the ball 20 can be kicked at the device 50 from greater distances. An accurate kick results in the ball 20 bouncing back to the student 52. In addition, the student 52 can use this device 50 to learn to kick a soccer ball 20 with either his right or left foot and thereby increase his skill and confidence.

Figure 2:
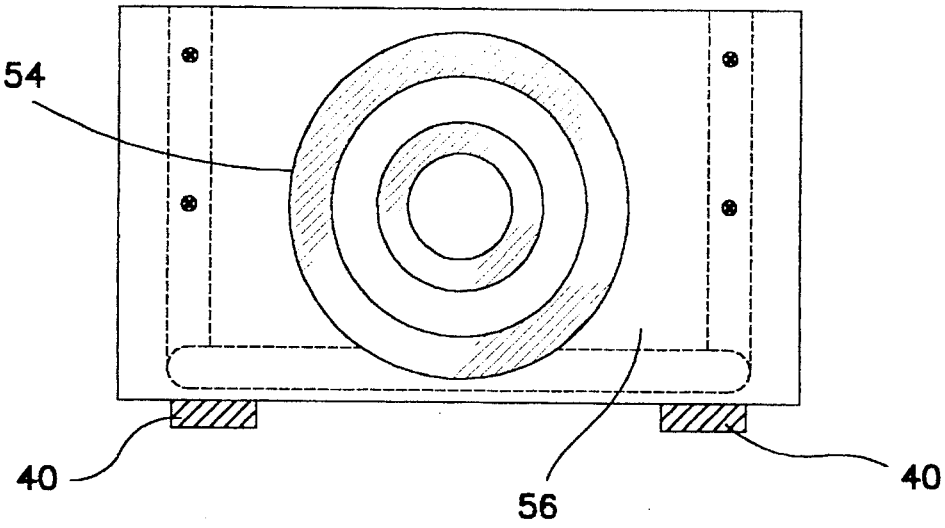
FIG. 2 is a front elevation view of a soccer practice device in accordance with the present invention.
Figure 3:
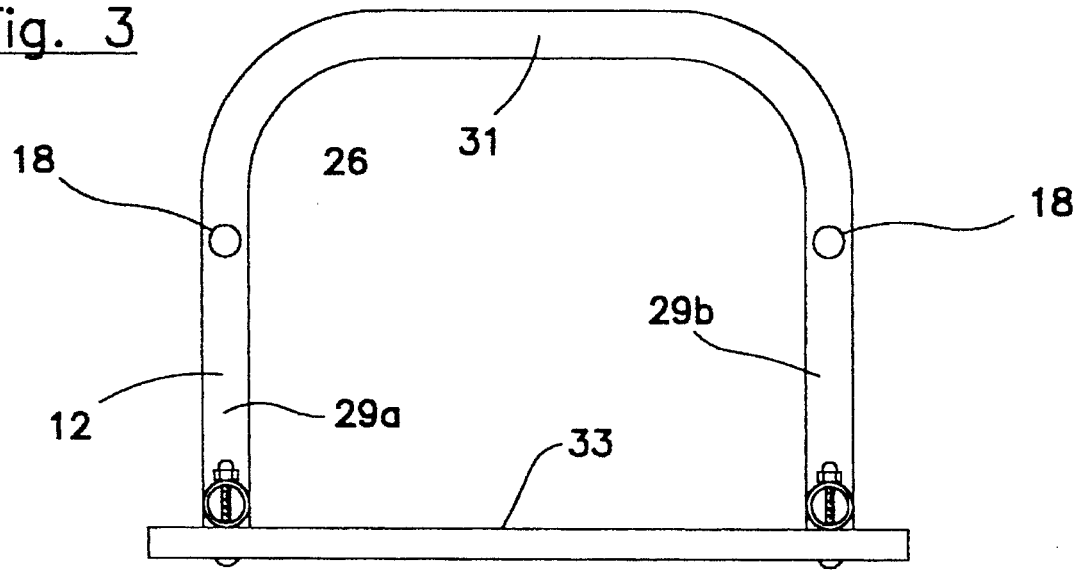
FIG. 3 is a top elevation view of a soccer practice device in accordance with the present invention.
Figure 4:
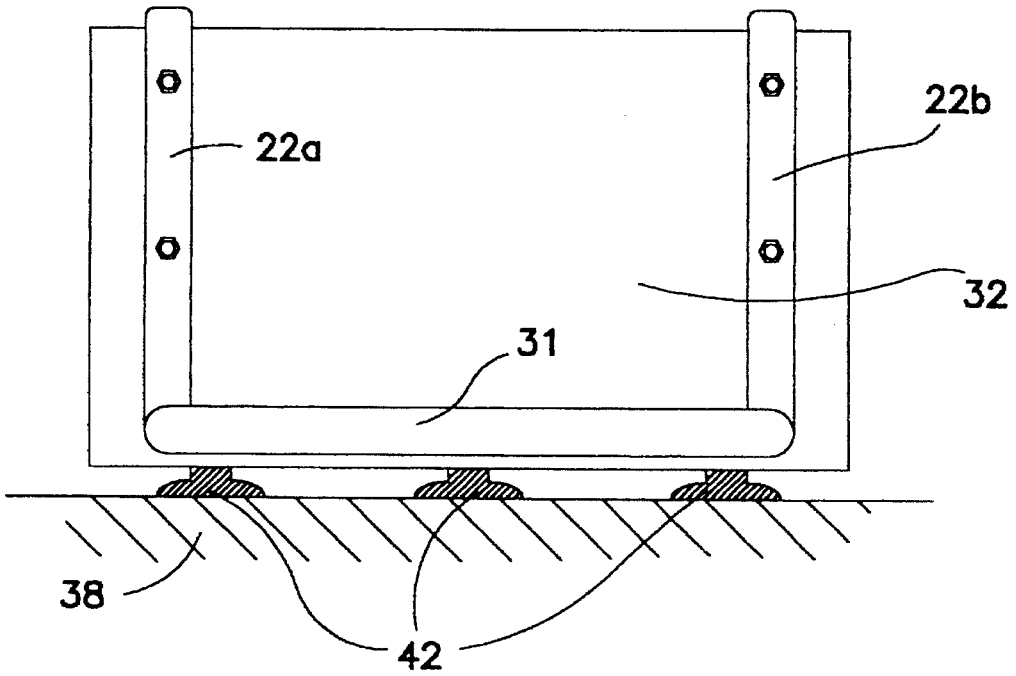
FIG. 4 is the back elevation view of a soccer practice device in accordance with the present invention.

The optional decal or graphic of a bullseye target 54 (as shown in FIG. 2) or company or team logo may be affixed to the exposed surface 56 of this rigid planar structure 32 thereby serving as a target on which the student 52 may direct his focus or as a marketing tool for companies who wish to associate themselves with the sport of soccer.

In accordance with one aspect of the present invention, FIG. 7 illustrates the ordinary use of the invention with the board 32 substantially perpendicular to the ground 16. The ball returns on a substantially straight trajectory.

In accordance with another aspect of the present invention, FIG. 8 illustrates the use of the device 50 with the board 32 angled off a perpendicular plane to the ground such that the ball 20 is deflected upward when it impacts the board 32. This setup is attained merely by reorienting the device 50 with respect to the ground 16 as shown.

In accordance with still another aspect of the present invention, FIG. 9 illustrates use of the device 50 as a practice goal with the optional feature of netting 51 connected via straps 53 to the frame 12. As compared to its orientation in FIGS. 1–4, here the device is shown reoriented between 90 and 150 degrees with respect a horizontal axis perpendicular to the student's line of sight to the device, and then rotated 180 degrees with respect to the vertical axis.

The previously described embodiments of the invention have many advantages, primary among them are multifunctional versatility in a compact, light weight design of a simple and inexpensive construction.

It should be understood that the foregoing disclosure relates to only a preferred embodiment of the invention and that it is intended to cover all changes and modifications of the example of the invention herein chosen for the purposes of the disclosure which do not constitute departures from the spirit and scope of the invention as set forth in the claims. For example, the frame structure herein described may be designed in a variety of shapes and may be replaced with telescoping or other deployable supports without departing from the spirit and scope of the invention.

I claim:

1. A practice device for use in practicing a sport, said device comprising:

a rigid planar structure, said structure having at least one exposed substantially unobstructed surface against which a resilient ball may be deflected;

a frame attached to said rigid planar structure and comprising at least one member which may be positioned such that it is substantially perpendicular to said rigid planar structure;

netting material fastened to said frame such that a goal is formed when said rigid planar structure is fastened face-down to a playing surface; and fixturing means wherein said practice device may be fixtured to said playing surface.

2. The practice device of claim 1 wherein said sport is soccer.

3. The practice device of claim 1 wherein said frame is tubular.

4. The practice device of claim 1 wherein said frame is made from materials selected from a group consisting of wood, plastic, fiberglass and metal.

5. The practice device of claim 1 wherein said frame is comprised of two separate supports fastened to said rigid planar structure.

6. The practice device of claim 1 wherein said frame is comprised of two separate supports which are collapsably attached to said frame such that said device may be compactly stored and transported.

7. The practice device of claim 1 wherein said fixturing means is selected from a group consisting of stakes, spikes, suction cups, frictional rubber pads, screws and clamps.

8. The practice device of claim 1 wherein said rigid planar structure is comprised of a material selected from a group consisting of wood, metal, fiberglass, and plastic.

* * * * *